US007159569B2

(12) United States Patent
Keegan et al.

(10) Patent No.: US 7,159,569 B2
(45) Date of Patent: Jan. 9, 2007

(54) FABRICATED FUEL RAIL ASSEMBLY FOR DIRECT INJECTION OF FUEL

(75) Inventors: Kevin R. Keegan, Hilton, NY (US); Michael J. Colletti, Rochester, NY (US); Charles J. Badura, Penfield, NY (US); John R. Socha, Pavillion, NY (US); Duane Potter, Webster, NY (US); Allan R. Wells, Rochester, NY (US); Patrick A. Furchill, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/126,810

(22) Filed: May 11, 2005

(65) Prior Publication Data

US 2006/0254563 A1 Nov. 16, 2006

(51) Int. Cl.
*F02M 69/46* (2006.01)
*F02M 69/50* (2006.01)

(52) U.S. Cl. ..... 123/456; 123/469

(58) Field of Classification Search ..... 123/456, 123/447, 468, 469, 470
See application file for complete search history.

(56) References Cited

U.S. PATENT DOCUMENTS

| | | | | |
|---|---|---|---|---|
| 5,111,794 | A * | 5/1992 | DeGrace, Jr. | 123/470 |
| 5,163,406 | A * | 11/1992 | Daly et al. | 123/456 |
| 5,211,149 | A * | 5/1993 | DeGrace, Jr. | 123/470 |
| 6,053,148 | A * | 4/2000 | Glovatsky et al. | 123/470 |
| 6,903,275 | B1 * | 6/2005 | Jetton | 174/72 A |

* cited by examiner

*Primary Examiner*—Mahmoud Gimie
(74) *Attorney, Agent, or Firm*—Paul L. Marshall

(57) ABSTRACT

A precision fuel rail assembly for direct fuel injection comprising a plurality of formed parts first assembled and positioned loosely on a precision fixture, then joined (e.g. tack welded), by applying a BFM on all joints forming a "green" assembly and firing in a brazing oven, to produce a precision assembly formed from stainless steel parts. A bracket defining a sole plate for the assembly may be formed as a continuous element or a plurality of individual fuel rail brackets. Flanged sockets are attached to the bracket at locations corresponding to the fuel injector locations on an engine bank. Bolt holes are provided along the centerline of the sockets and fuel injectors. The bracket supports a fuel distribution tube via saddle elements disposed between the bracket and the tube. A jump tube supplies fuel from the distribution tube to each socket.

25 Claims, 4 Drawing Sheets

FABRICATED FUEL RAIL ASSEMBLY FOR DIRECT INJECTION OF FUEL

TECHNICAL FIELD

The present invention relates to fuel rail assemblies for supplying fuel to fuel injectors of internal combustion engines; more particularly, to fuel rail assemblies for supplying fuel for direct injection of gasoline (DIG) or diesel fuel (DID) into engine cylinders; and most particularly, to an improved DIG/DID fuel rail assembled by precision placement and brazing of rail components without inducing stress in the final brazed assembly.

BACKGROUND OF THE INVENTION

Fuel rails for supplying fuel to fuel injectors of internal combustion engines are well known. A fuel rail assembly, also referred to herein simply as a fuel rail, is essentially an elongate fuel manifold connected at an inlet end to a fuel supply system and having a plurality of ports for mating in any of various arrangements with a plurality of fuel injectors to be supplied. Typically, a fuel rail assembly includes a plurality of fuel injector sockets in communication with a manifold supply tube, the injectors being inserted into the sockets and held in place in an engine head by bolts securing the fuel rail assembly to the head.

Gasoline fuel injection arrangements may be divided generally into multi-port fuel injection (MPFI), wherein fuel is injected into a runner of an air intake manifold ahead of a cylinder intake valve, and direct injection (DIG), wherein fuel is injected directly into an engine cylinder, typically during or at the end of the compression stroke of the piston. Diesel fuel injection is also a direct injection type.

For purposes of clarity and brevity, wherever DIG is used herein it should be taken to mean both DIG and DID, and fuel cell rail assemblies in accordance with the invention as described below are useful in both DIG and DID engines.

DIG fuel rails require high precision in the placement of the injector sockets in the supply tube because the spacing and orientation of the sockets along the fuel rail assembly must exactly match the three-dimensional spacing and orientation of the fuel injectors as installed in cylinder ports in the engine. Further, a DIG fuel rail must sustain much higher fuel pressures than a MPFI fuel rail to assure proper injection of fuel into a cylinder having a compressed charge. DIG fuel rails may be pressurized to 100 atmospheres or more, for example, whereas MPFI fuel rails must sustain pressures of only about 4 atmospheres.

Efforts to form satisfactory DIG fuel rails by metal forming and welding have not heretofore been successful. The bending and welding processes can produce significant stresses in the formed parts, and even slight misalignments of components such as sockets mounted into the distribution tube can create even further stresses when the assembly is bolted to an engine head.

In response to these problems and requirements, DIG fuel rails typically are formed by precision casting followed by boring of various passages, or by precision/high cost machining of stainless steel. However, prior art cast fuel rails suffer from at least three serious shortcomings. First, they are expensive to manufacture, requiring multiple steps in casting, boring, and finishing. Second, they are typically an aluminum alloy, which is known to be subject to attack by some fuels. Desirable resistant alloys such as stainless steel are more costly to cast. Third, bolts securing a typical prior art fuel rail assembly to an engine head are typically offset from the centerlines of the fuel injectors, such that cylinder pressure on the fuel injectors exerts a torque on the bolts and the assembly which can result in progressive misalignment of the fuel rail with the injectors and potentially failure of the fuel injection system.

What is needed in the art is an inexpensive fuel rail for DIG engine fuel systems.

What is further needed in the art is a DIG fuel rail assembly formed of a non-reactive metal alloy such as stainless steel.

What is further needed in the art is a DIG fuel rail wherein the bolts securing the rail assembly to an engine head lie on the centerline of the fuel injectors.

It is a principal object of the present invention to provide an inexpensive, high-precision fuel rail assembly for use with a DIG or DID internal combustion engine.

SUMMARY OF THE INVENTION

Briefly described, a fuel rail assembly in accordance with the invention comprises a plurality of formed parts first assembled loosely on a precision fixture, then joined to fix relationships, containing braze filler metal (BFM), as for example, paste, preforms, or plating on all joints to form a "green" assembly, and fired in a brazing oven to produce a precision, fuel rail assembly formed from stainless steel parts.

A bracket defines a sole plate for the assembly, for attachment to an engine head in the region of direct injection fuel injectors. The bracket may be formed as a single, continuous element comprising all the fuel injector sites, or may be formed of a plurality of individual fuel injector brackets. Assembly is similar for either style. Flanged sockets for receiving the outer ends of the fuel injectors are attached to the bracket at locations corresponding to the fuel injector locations on an engine bank. Bolt holes are provided through the bracket on either side of each socket along the centerline of the sockets and fuel injectors. The bracket extends to one side of the sockets and is formed to support a fuel distribution tube. At least one saddle element is disposed between the bracket and the tube. A jump tube extends from the fuel distribution tube to each socket for supplying fuel from the distribution tube to each fuel injector.

Preferably, all components are formed of a non-reactive, brazable alloy such as stainless steel, for example, 304 stainless steel.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
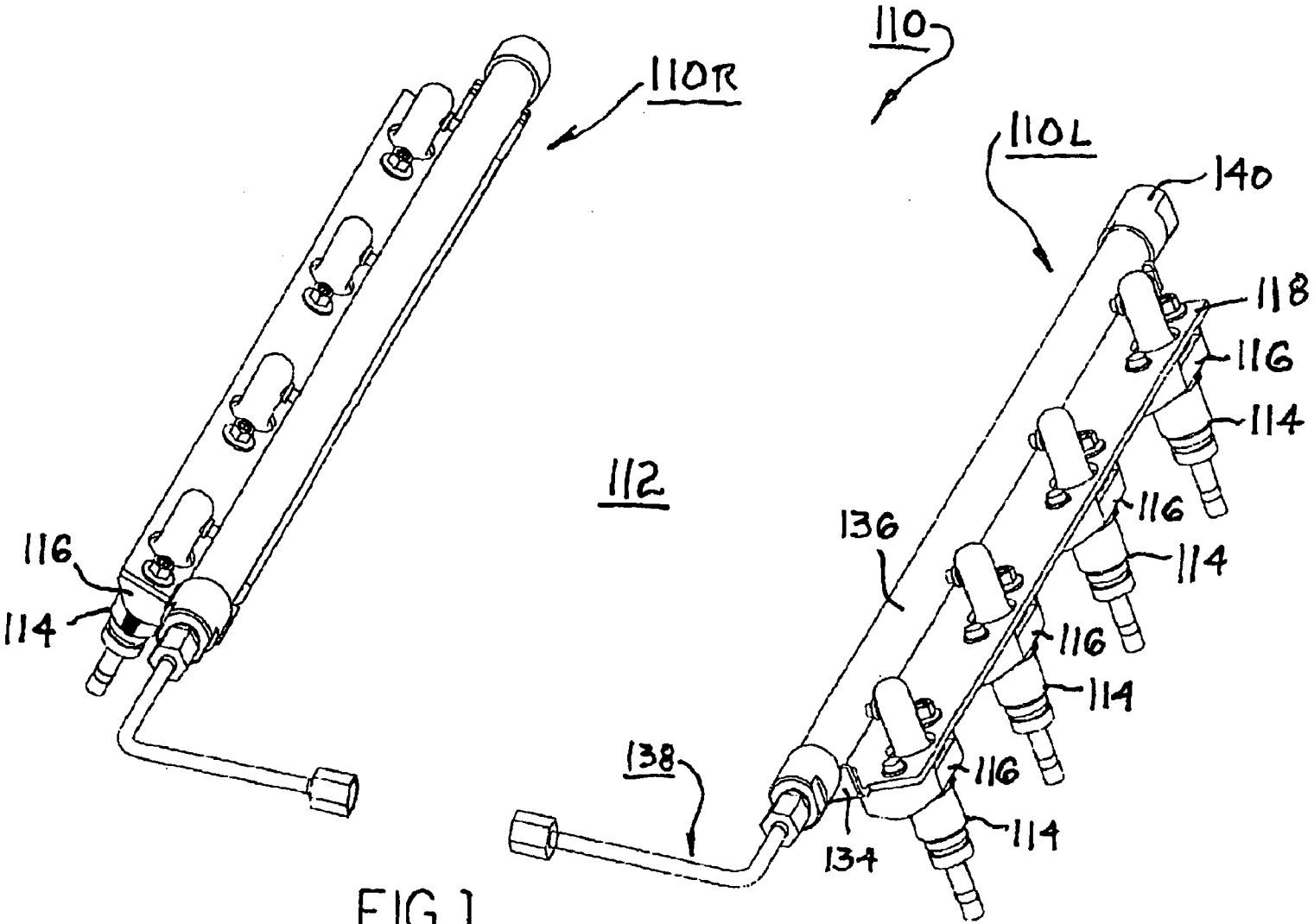
FIG. 1 is an isometric view from above of left and right fuel rail assemblies in accordance with the invention, as formed for the left and right heads of a V-8 engine.
Figure 2:
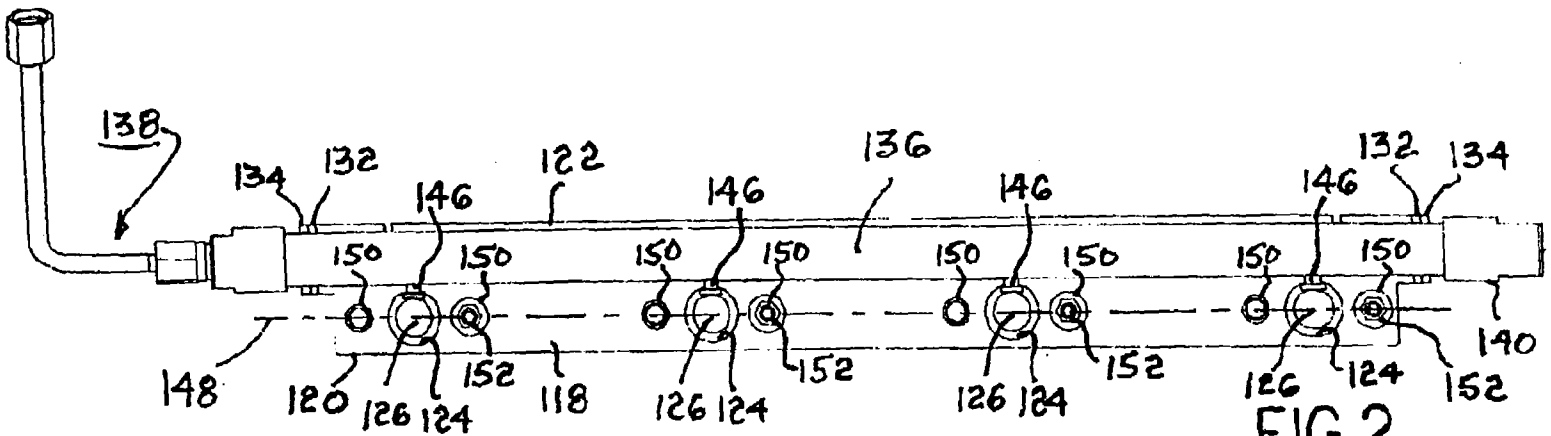
FIG. 2 is a plan view of the left fuel rail assembly shown in FIG. 1.
Figure 3:
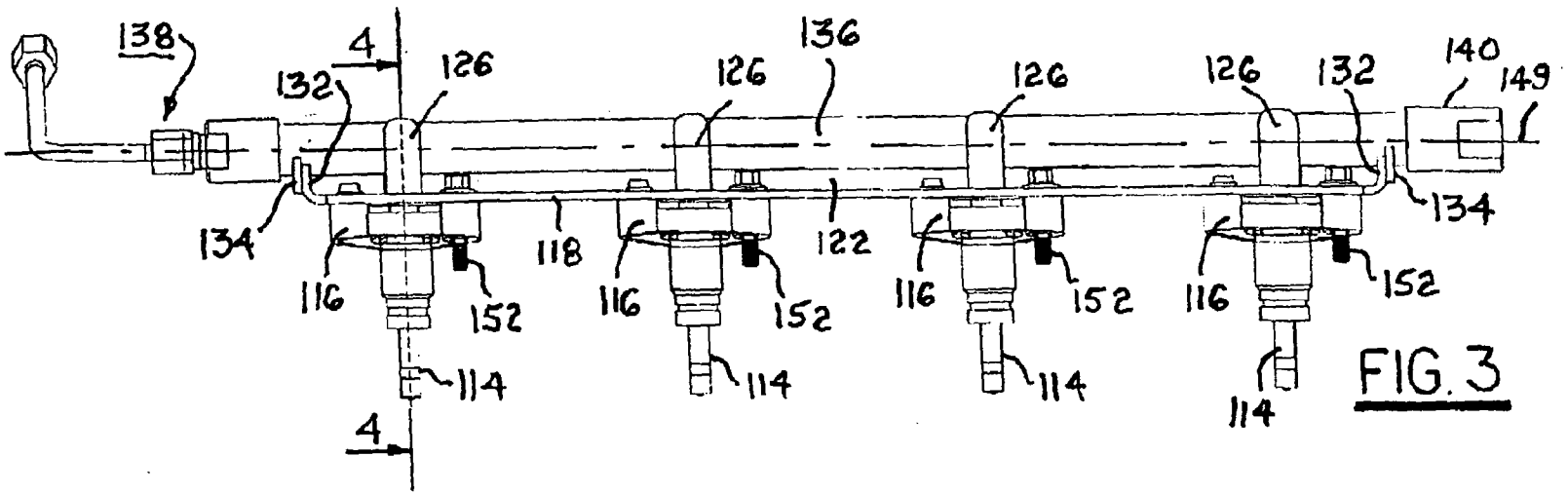
FIG. 3 is an elevational view of the left fuel rail assembly shown in FIG. 1.

Referring to FIG. 1, two fuel rail assemblies 110 in accordance with the invention are shown exemplarily arranged as for use on a V-8 engine 112 (left assembly 110L, right assembly 110R). For simplicity, the following description deals solely with left assembly 110L (referred to herein below as "110") but should be taken as applying equally to right assembly 110R. Further, the fuel rail assemblies are shown as being installed on a plurality of fuel injectors 114 with tapered adapters 116, neither of which is an element of an assembly 110 but which are shown to illustrate the relationship of the fuel rail assemblies to associated components.

Referring to FIGS. 1 through 4, fuel rail assembly 110 comprises a metal bracket 118 having a foot portion 120, defining a sole plate for mating with an engine head, and a flange portion 122 formed generally orthogonal to foot portion 120 for structural rigidity. Foot portion 120 is provided with a plurality of openings 124 for receiving a plurality of formed sockets 126, each having a flange 128 for mating with the underside surface 130 of portion 120, and an open end 131. Openings 124 are oversize to allow lateral positioning adjustment of sockets 126 during assembly of the fuel rail as described below. Bracket 118 further comprises a flange 132 at each end for supporting a saddle 134. Supported by saddles 134 is a fuel distribution tube 136 having a fuel supply tube and fittings 138 at a first end and a cap 140 at a second end. Each socket 126 is provided with an opening 142 in a side thereof, and distribution tube is provided with a plurality of matching openings 144, wherein jump tubes 146 are received for supplying fuel from tube 136 to each socket 126.

The centerline 148 of openings 124 and sockets 126 corresponds to the centerline of fuel injectors 114 in engine 112. Holes 150 are provided along centerline 148, preferably two such holes on opposite sides of each opening 124, for securing fuel rail assembly 110 to engine 112 as by one or more bolts 152. Tapered adapters 116, which are formed preferably from a moldable, high-temperature polymer, may be installed between bracket 118 and engine 112, as shown in FIG. 1, for adapting fuel rail assembly 110 to various engine heads having the same fuel injector spacing and diameters but differing head surface slopes and/or fuel injector protrusion lengths.

It is an important advantage of a fuel rail assembly in accordance with the present invention that the mounting bolts lie along the centerline of the fuel injectors such that no bending torque is applied to the bolts by expellant pressures exerted on the fuel injectors. Further, the bolt line 148 is offset from the axis 149 of the fuel distribution tube, obviating steric hindrances present in some prior art fuel rails wherein the bolts are disposed under the distribution tube, a significant manufacturing and maintenance disadvantage.

Further, it is an important feature and object of a fuel rail assembly in accordance with the invention that the assembly be formed without internal stresses and that the assembly fit precisely onto an engine head wherein the fuel injectors have been inserted and are extending from their respective precision bores. Accordingly, the components of the fuel rail are assembled loosely onto a fixture simulating such an engine head, to assure proper orientations and positions of the components, then are secured to each other to prohibit further relative motion, and then are sealed to each other as by brazing.

Figure 5:
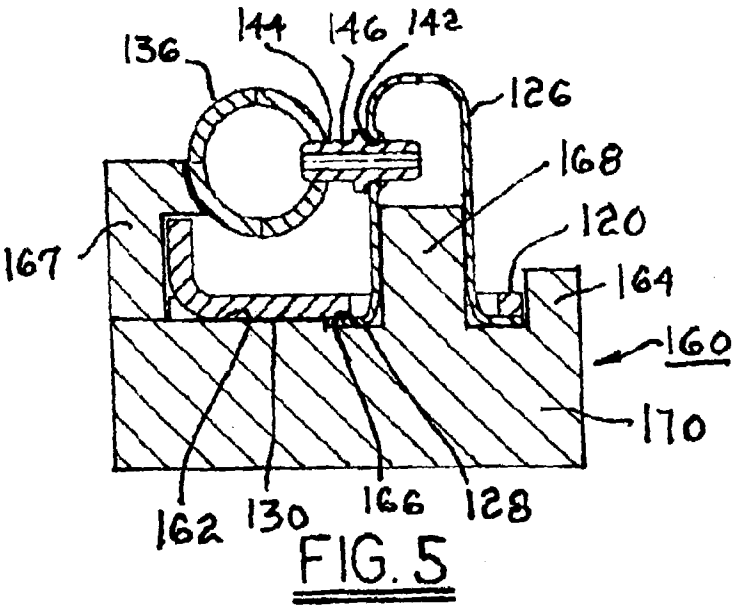
FIG. 5 is an elevational cross-sectional view of components of a fuel rail in accordance with the invention laid up in a jig for preliminary welding.
Figure 4:
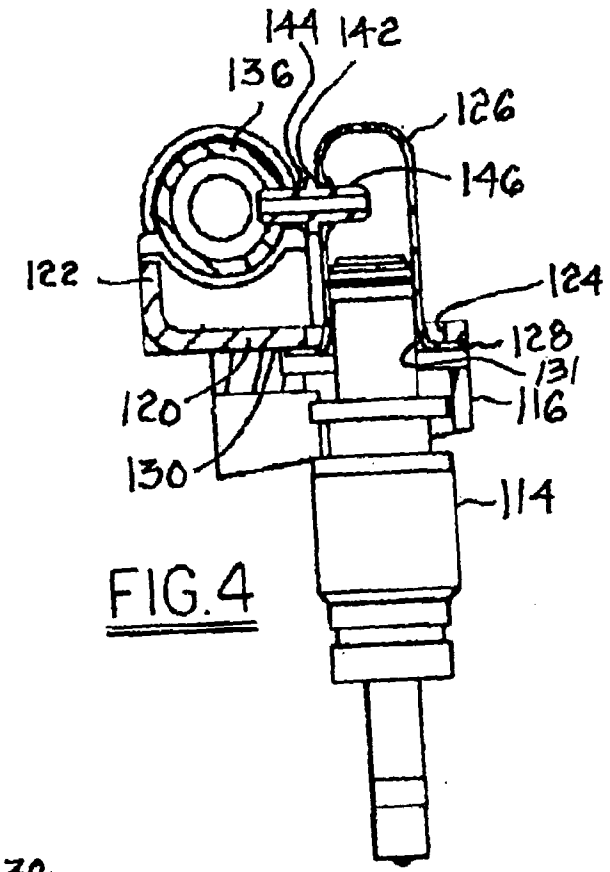
FIG. 4 is an elevational cross-sectional view taken along line 4—4 in FIG. 3.
Figure 6:
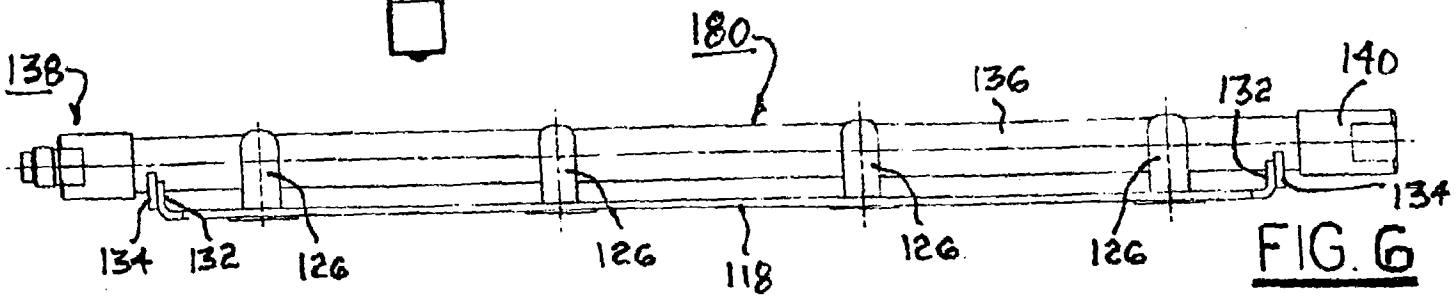
FIG. 6 is a side view of a "green" assembly as taken from the jig preparatory to being fired in a braze oven.

Referring now to FIGS. 5 and 6, an exemplary, schematic assembly fixture 160 includes (for each fuel injector location) a first reference surface 162 for receiving surface 130 of bracket 118, a flange 164 for laterally positioning bracket 118, a second surface 166 for receiving flange 128 of socket 126, and a brace 167 for supporting distribution tube 136. A mandrel 168, simulating a fuel injector in an engine, extends from fixture base 170 into open end 131 of socket 126 for properly positioning socket 126 within opening 124 and properly aligning socket 126 to fit without stress onto an actual fuel injector.

Still referring to FIGS. 5 and 6, an exemplary method for assembling a fuel rail assembly in accordance with the invention comprises the steps of:

a) installing a socket 126 onto each mandrel 168 and surface 166;

b) installing a bracket 118 onto sockets 126, surface 130, and against flange 164;

c) inserting a jump tube 146 into each socket side opening 142;

d) installing a fuel distribution tube 136 by inserting the other ends of jump tubes 146 into tube openings 144, and supporting installed tube 136 with brace 167;

e) engaging saddles 134 with flanges 132 and distribution tube 136;

f) joining, as for example by tack welding, all components together;

g) removing the tack-welded assembly from fixture 160;

h) applying a BFM, as for example, as a paste, preform or plating, to all joints and seams to form a "green" fuel rail assembly 180; and i) heating green assembly 180, as in a brazing oven (not shown) to seal and/or join with braze all joints and seams.

Figure 7:
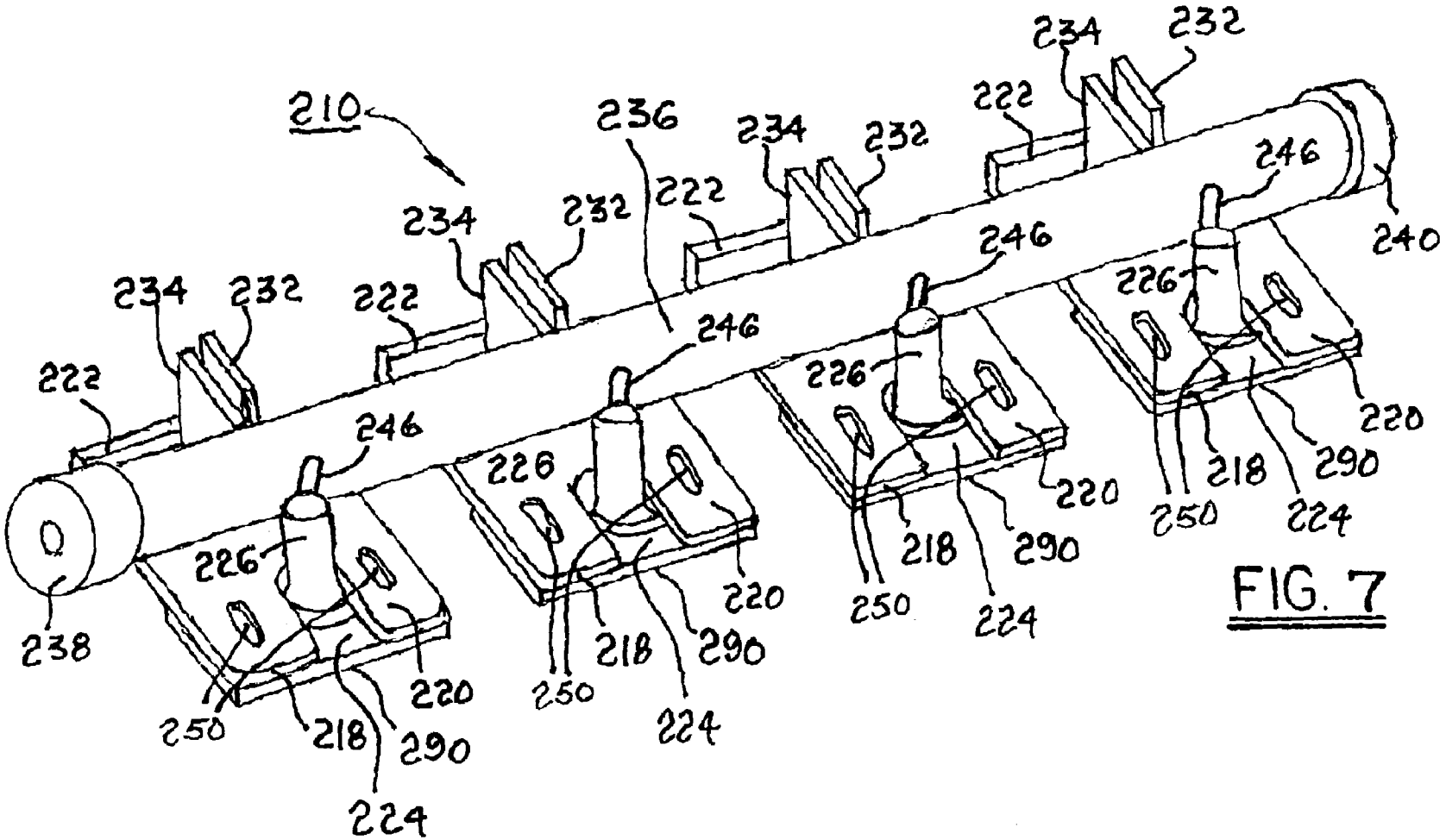
FIG. 7 is an isometric view of a second embodiment of a fuel rail assembly in accordance with the invention.

Referring now to FIG. 7, a second embodiment 210 of a fuel rail assembly in accordance with the invention is similar to first embodiment 110 except that single bracket 118 is replaced by a plurality of individual brackets 218, one for each fuel injector position. Each bracket 218 comprises a sole plate 220 and a generally orthogonal first flange 222 for structural rigidity. A second flange 232 on bracket 218 is supportive of a saddle 234, one for each bracket 218. Saddles 234 are supportive of fuel distribution tube 236. Brackets 218 are provided with oversize slotted openings 224 for receiving sockets 226 which are retained by retaining plates 290. Jump tubes 246 are connected between distribution tube 236 and sockets 226. Tube 236 is closed by a fuel supply tube and fittings 238 at a first end and a cap 240 at a second end. Brackets 218 are provided with elongated bolt holes 250 for bolting assembly 210 to an engine head.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel rail assembly for supplying fuel to a fuel injector of an internal combustion engine, comprising:

a) a bracket having an opening there through corresponding to the location of said fuel injector in said engine;

b) a socket having an open end for receiving an inlet end of said fuel injector to provide fuel thereto when said assembly is installed on said engine, said socket being disposed in said bracket opening, wherein a moveable joint is formed between said socket and said bracket prior to fixedly coupling said socket with said bracket;

c) a fuel distribution tube for providing fuel under pressure to said socket from a fuel pressurizing source;

d) a saddle extending from said bracket for supporting said fuel distribution tube, wherein a moveable joint is formed between said saddle and said fuel distribution tube prior to fixedly coupling said saddle with said fuel distribution tube; and e) a jump tube extending between said fuel distribution tube and said socket for providing fuel from said fuel distribution tube to said socket.

2. A fuel rail assembly in accordance with claim 1 wherein said socket includes a flange formed around said socket open end and having a diameter greater than the diameter of said bracket opening for engaging said bracket.

3. A fuel rail assembly in accordance with claim 1 wherein said bracket has a plurality of openings corresponding to the location of a plurality of fuel injectors in said engine, said openings having a common centerline, wherein at least one hole is provided in said bracket on said centerline to permit bolting of said assembly to an engine head.

4. A fuel rail assembly in accordance with claim 1 formed by assembly and welding together of said bracket, said socket, said saddle, and said jump tube on a precision fixture.

5. A fuel rail assembly in accordance with claim 4 wherein said precision fixture is representative of an engine head having the inlet end of a fuel injector extending therefrom.

6. A fuel rail assembly in accordance with claim 1 wherein said assembly includes brazed joints between said bracket, said socket, said saddle, and said jump tube.

7. A fuel rail assembly for supplying fuel to a plurality of fuel injectors of an internal combustion engine, comprising:

a) a bracket having a plurality of openings therethrough corresponding to the locations of said fuel injectors in said engine;

b) a plurality of sockets, each having an open end for receiving an inlet end of one of said fuel injectors, to provide fuel thereto when said assembly is installed on said engine, each of said sockets being disposed in one of said bracket openings, wherein a moveable joint is formed between each of said plurality of sockets and said bracket prior to fixedly coupling said plurality of sockets with said bracket;

c) a fuel distribution tube for providing fuel under pressure to said sockets from a fuel pressurizing source;

d) a saddle extending from said bracket for supporting said fuel distribution tube, wherein a moveable joint is formed between said saddle and said fuel distribution tube prior to fixedly coupling said saddle with said fuel distribution tube; and e) a plurality of jump tubes extending between said fuel distribution tube and to each of said sockets for providing fuel from said fuel distribution tube to said sockets.

8. A fuel rail assembly in accordance with claim 7 wherein the axis of said fuel distribution tube lies outside a plane containing the axes of said fuel injectors.

9. A fuel rail assembly in accordance with claim 7 wherein at least one hole is provided in said bracket adjacent each of said openings to permit bolting of said assembly to an engine head.

10. A fuel rail assembly in accordance with claim 7 further including at least one adaptor disposed between said bracket and said engine.

11. A fuel rail assembly in accordance with claim 9 wherein said at least one hole is formed on a line extending through the center of all of said sockets.

12. A fuel rail assembly in accordance with claim 7 wherein each of said sockets includes a flange formed around said socket open end and having a diameter greater than the diameter of said bracket opening for engaging said bracket.

13. A fuel rail assembly in accordance with claim 7 formed by assembly and welding together of said bracket, said fuel distribution tube, said sockets, said saddle, and said jump tubes on a precision fixture.

14. A fuel rail assembly in accordance with claim 13 wherein said precision fixture is representative of an engine head having the inlet ends of a plurality of fuel injectors extending therefrom.

15. A fuel rail assembly in accordance with claim 7 wherein said assembly includes brazed joints between said bracket, said fuel distribution tube, said sockets, said saddle, and said jump tubes.

16. A fuel rail assembly in accordance with claim 7 wherein at least one of said bracket, said fuel distribution tube, said sockets, said saddle, and said jump tubes is formed from stainless steel.

17. A fuel rail assembly in accordance with claim 7 wherein said assembly is adapted to provide fuel to direct-injection fuel injectors.

18. A fuel rail assembly in accordance with claim 17 wherein said fuel is selected from the group consisting of gasoline and diesel fuel.

19. A fuel rail assembly in accordance with claim 7 wherein said bracket comprises a plurality of individual brackets, one for each of said sockets.

20. A fuel-injected internal combustion engine comprising a fuel rail assembly including a bracket having a plurality of openings therethrough corresponding to the locations of said fuel injectors in said engine, a plurality of sockets, each having an open end for receiving an inlet end of one of said fuel injectors, to provide fuel thereto when said assembly is installed on said engine, each of said sockets being disposed in one of said bracket openings, wherein a moveable joint is formed between each of said plurality of sockets and said bracket prior to fixedly coupling said plurality of sockets with said bracket, a fuel distribution tube for providing fuel under pressure to said sockets from a fuel pressurizing source, a saddle extending from said bracket for supporting said fuel distribution tubes, wherein a moveable joint is formed between said saddle and said fuel distribution tube prior to fixedly coupling said saddle with said fuel distribution tube, and a plurality of jump tubes extending between said fuel distribution tube and to each of said sockets for providing fuel from said fuel distribution tube to said sockets.

21. A fuel-injected internal combustion engine in accordance with claim 20 further including at least one adaptor disposed between said bracket and said engine.

22. A method for forming a fuel rail assembly from components including a bracket having a plurality of openings corresponding to the locations of fuel injectors in an internal combustion engine, a plurality of sockets, a fuel distribution tube, a plurality of jump tubes, and a plurality of saddles, the method comprising the steps of:

a) providing an assembly fixture simulative of an engine head and including a plurality of mandrels extending there from in simulation in dimension and spacing of the inlet ends of a plurality of fuel injectors extending from an engine head;

b) installing a socket onto each of said mandrels;

c) installing said bracket onto said sockets by entering a one of said sockets into each of said bracket openings;

d) inserting a jump tube into a side opening in each socket;

e) installing a fuel distribution tube by inserting the other ends of said jump tubes into openings in said distribution tube;

f) engaging said saddles with said bracket and said distribution tube; and g) joining all components together to form an assembly.

23. A method in accordance with claim 22 wherein said joining step includes brazing all joints and seams.

24. A method in accordance with claim 22 wherein said joining step includes tack welding.

25. A method in accordance with claim 24 wherein said joining step further includes brazing all joints and seams.

* * * * *